US009885281B2

(12) United States Patent
Zhang

(10) Patent No.: US 9,885,281 B2
(45) Date of Patent: Feb. 6, 2018

(54) ENGINE SYSTEM WITH TWO PISTONS

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/181,262

(22) Filed: Jun. 13, 2016

(65) Prior Publication Data

US 2017/0356336 A1 Dec. 14, 2017

(51) Int. Cl.
*F02B 75/30* (2006.01)

(52) U.S. Cl.
CPC ..... *F02B 75/30* (2013.01)

(58) Field of Classification Search
CPC ..... F02B 75/044; F02B 75/30
USPC ..... 123/78 B, 197.2, 48 A, 48 AA
See application file for complete search history.

(56) References Cited

U.S. PATENT DOCUMENTS 4,515,114 A * 5/1985 Dang ..... F02B 41/00 123/48 B
4,776,308 A 10/1988 Blackburn
5,357,919 A 10/1994 Ma
5,549,087 A * 8/1996 Gray, Jr. ..... F02B 23/0603 123/254
5,617,823 A * 4/1997 Gray, Jr. ..... F02B 23/101 123/254
5,769,042 A * 6/1998 Popadiuc ..... F02B 41/00 123/78 B
5,865,092 A * 2/1999 Woudwyk ..... F02B 75/30 123/48 B
5,908,012 A * 6/1999 Endoh ..... F02B 21/02 123/41.35
6,752,105 B2 * 6/2004 Gray, Jr. ..... F02B 75/045 123/48 B
6,935,299 B2 * 8/2005 Meyer ..... F02B 75/041 123/197.1
7,146,940 B2 * 12/2006 Knutsen ..... F02B 75/042 123/48 B
9,347,385 B2 * 5/2016 Kim ..... F02D 15/02
2006/0150940 A1 7/2006 Kurt et al.

* cited by examiner

*Primary Examiner* — Hai Huynh
(74) *Attorney, Agent, or Firm* — Julia Voutyras; McCoy Russell LLP

(57) ABSTRACT

An engine system is provided. The engine system includes a first piston movable within a cylinder, a second piston movable within a hollow body of the first piston, the movement defining a boundary of a reservoir within the hollow body, a spring device coupled to the first piston and the second piston, and a vent passage fluidically connecting the reservoir to the cylinder.

19 Claims, 6 Drawing Sheets

ENGINE SYSTEM WITH TWO PISTONS

BACKGROUND/SUMMARY

During operation of an internal combustion engine fuel can be pushed into the small gap between the piston and the cylinder wall during a compression stroke. During the next expansion stroke fuel remains trapped in the small gap and does not combust. Only during a subsequent exhaust stroke may the trapped fuel escape from the gap into the cylinder. The released fuel will flow into the exhaust system instead of being ignited during an expansion stroke. As a result, engine emissions may be increased and engine efficiency and fuel economy may be decreased.

As such in one approach, an engine system is provided. The engine system includes a first piston movable within a cylinder, a second piston movable within a hollow body of the first piston, the movement defining a boundary of a reservoir within the hollow body, a spring device coupled to the first piston and the second piston, and a vent passage fluidically connecting the reservoir to the cylinder. In this way, the vent passage can provide fluidic communication between the reservoir and cylinder to enable the reservoir to receive gases, such as hydrocarbons, during an exhaust stroke and release the gases during a subsequent expansion stroke. Consequently, hydrocarbons, which in previous engines would be released into the cylinder during an exhaust stroke, can be stored in the reservoir and released during desired combustion cycle phases. As a result, engine emissions are reduced.

The inventors herein have recognized the above issues and potential options to address them. The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

This description relates to systems and methods for flowing gas into and out of a reservoir in a hollow body of a piston. The gas flow pattern into and out of the piston reservoir reduces emissions caused by hydrocarbons (e.g., unburnt fuel) trapped between a cylinder wall and an outer surface of the piston during a compression stroke and released into the cylinder during a subsequent exhaust stroke. The gas flow pattern into the piston reservoir can also provide internal exhaust gas recirculation (EGR) functionality by filling the reservoir with exhaust gas during an exhaust stroke and storing the exhaust gas in the reservoir until subsequent compression and expansion strokes when it is released back into the cylinder. The gas flow between the cylinder and the reservoir is enabled by one or more vent passages fluidly connecting the reservoir to the cylinder, the vent passages outwardly extend through the first piston. Correspondingly, the gas flow into and out of the piston reservoir is generated through movement of a second piston positioned with the first piston during different combustion cylinder strokes. In particular, during an exhaust stroke the second piston moves upward, increasing the volume of the reservoir to generate gas flow into the reservoir. In this way, hydrocarbons in a gap between the cylinder wall and the piston's outer surface are flowed into and temporarily stored in the reservoir instead of remaining trapped in the gap. During a subsequent compression stroke the second piston moves downward, decreasing the volume of the reservoir to release the hydrocarbons stored in the reservoir into the cylinder. As such, the hydrocarbons are combusted during the following expansion stroke. Therefore emissions from the engine are reduced, thereby decreasing the engine's environmental impact.

Figure 1:
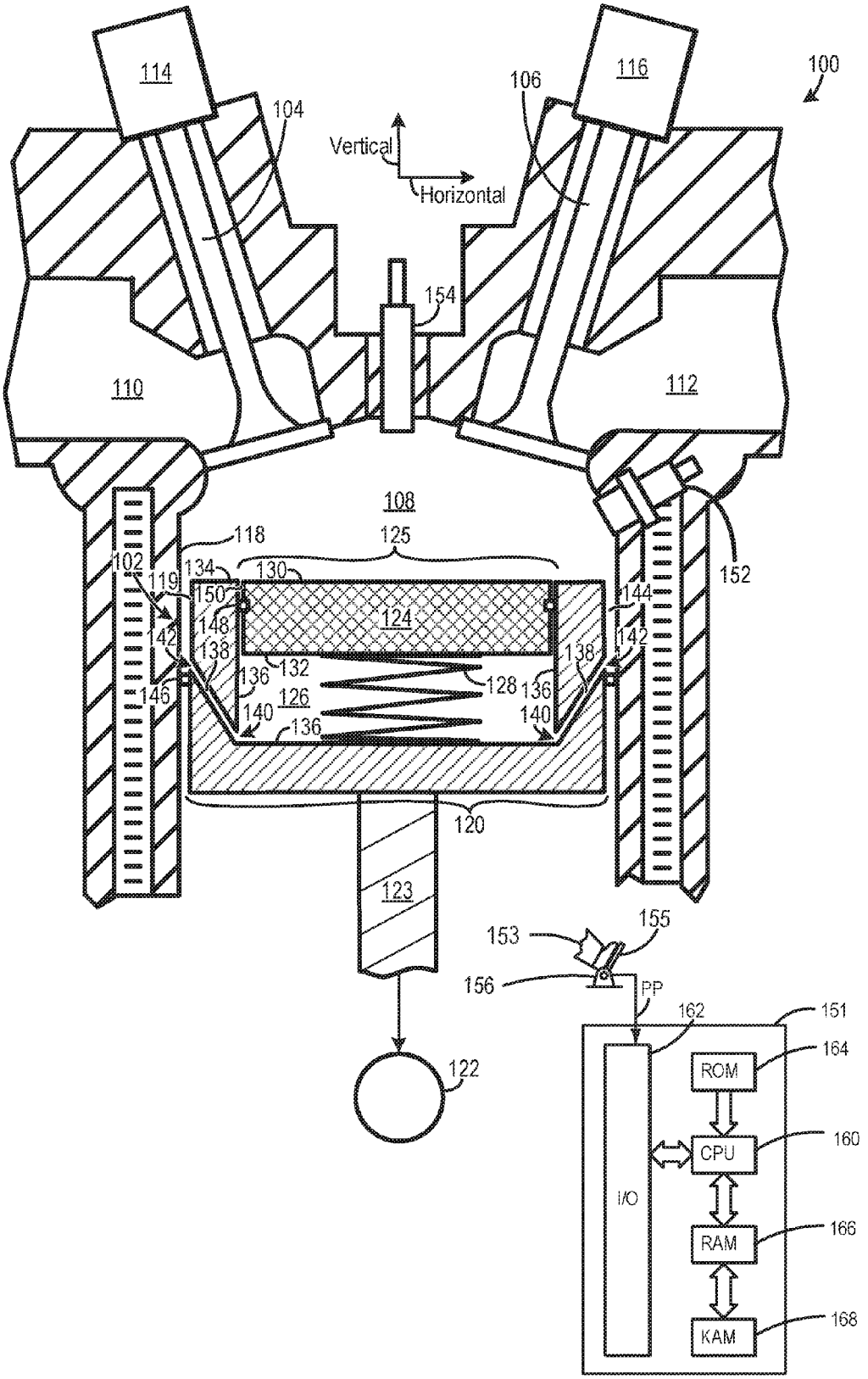
FIG. 1 shows a view of an engine system in an engine, the engine system including a second piston moveable in a hollow body of a first piston.

FIG. 1 shows an engine 100 with an engine system 102 in a cross-sectional view. The engine 100 includes various components that facilitate combustion operation such as an intake valve 104 and an exhaust valve 106 coupled to a cylinder 108. An intake conduit 110 is also provided in the engine to enable intake airflow into the cylinder 108. Likewise an exhaust conduit 112 is provided in the engine 100 to enable exhaust gas to be expelled from the cylinder 108.

An intake valve actuator 114 is coupled to the intake valve 104 and is configured to open and close the intake valve 104 at desired time intervals. Likewise, an exhaust valve actuator 116 is coupled to the exhaust valve 106 and is configured to open and close the exhaust valve 106 at desired time intervals. The intake and exhaust valve actuators 114 and 116 may be cams, electronic actuators, or other suitable devices configured to actuate each respective valve.

The cylinder 108 includes a cylinder wall 118 with a first piston 120 positioned therein. The first piston 120 is included in the engine system 102. The first piston 120 may be coupled to a crankshaft 122 through a piston rod 123 so that reciprocating motion of the first piston is translated into rotational motion of the crankshaft. It will be appreciated that the piston rod 123 and first piston 120 may be constructed out of different materials, in one example. The crankshaft 122 may be coupled to at least one drive wheel of a vehicle via an intermediate transmission system. Further, a starter motor may be coupled to the crankshaft 122 via a flywheel to enable a starting operation of engine 100.

The engine system 102 also includes a second piston 124 moveable within a hollow body 125 of the first piston 120. The pressure differential between the cylinder 108 and the reservoir 126 affects the movement of the second piston 124. The movement of the second piston 124 generates gas flow into and out of a reservoir 126 of the hollow body 125. The reservoir 126 can have a cylindrical shape or other suitable geometries.

A spring device 128 is coupled to the first piston 120 and the second piston 124 and is included in the engine system 102. The spring device 128 is embodied as a coil spring in FIG. 1. However, other types of spring devices have been contemplated, such as leaf springs, wave springs, gas springs, etc. Additionally, the spring device 128 is positioned within the reservoir 126 in FIG. 1. Positioning the spring device 128 within the reservoir 126 can enable the compactness of the engine system 102 to be increased. However spring devices positioned external to the reservoir may be used, in other examples.

The spring device 128 exerts a return force on the second piston 124 when there is greater amount of pressure exerted on a top surface 130 of the second piston 124 than a bottom surface 132 of the second piston 124. As such, the spring device 128 enables the second piston 124 to move up and down, changing the volume of the reservoir 126 during different combustion cycles phases. The spring device 128 is in a neutral position in FIG. 1. Specifically in the depicted example, the spring device 128 is in the neutral position when the top surface 130 of the second piston being parallel to a top surface 134 of the first piston 120. However, other neutral position arrangements of the first and second pistons may be used.

The top surface 130 of the second piston 124 is open to the cylinder 108 while the bottom surface of the second piston is open to the reservoir 126. Specifically, the top surface 130 of the second piston 124 defines a portion of a boundary of the cylinder 108 while the bottom surface 132 of the second piston defines a portion of a boundary of the reservoir 126. Another portion of the boundary of the cylinder 108 is also defined by the cylinder wall 118. Additionally, interior surfaces 136 of the first piston 120 define another portion of the boundary of the reservoir 126. It will be appreciated that the volume and therefore boundary of the reservoir 126 changes due to the movement of the second piston 124. As such, gas (e.g., fuel vapor, exhaust gas, etc.,) can be flowed into and out of the reservoir 126 during desired phases of the combustion cycle to reduce emissions. The gas flow pattern into and out of the reservoir 126 is discussed in greater detail herein with regard to FIGS. 2-5.

The engine system 102 also include vent passages 138 providing fluidic connection between the cylinder 108 and the reservoir 126. It will be appreciated that the cutting plane of the cross-sectional view in FIG. 1 extends through the vent passages 138. In such a cross-sectional view, the vent passages 138 appear to form a boundary between two sections of the first piston 120 that are spaced apart from one another. However, this is not in fact the case. The first piston 120 is formed from a solid piece of material and therefore has a continuous shape. In one particular example, the first piston 120 can have the shape of a partially hollow cylinder with cylindrical vent passages extending through selected regions with material of the first piston extending around and defining boundaries of the vent passages. The vent passages 138 each include a first end 140 opening into the reservoir 126 and a second end 142 opening into a gap 144 between the cylinder wall 118 and an outer surface 119 of the first piston 120. The vent passages 138 extend upward and outward through the first piston 120, in the illustrated example. In other examples, the vent passages 138 may only extend outward through the first piston in a horizontal direction. Vertical and horizontal axes are provided for reference. However, other relative orientations of the engine system 102 have been contemplated. Although, two vent passages 138 are depicted in FIG. 1, an alternate number of vent passages 138 may be included in the engine system 102, such as a single vent passage or three or more vent passages extending through the first piston 120 from the reservoir 126 to the outer surface 119 of the first piston 120. Additionally in one example, the vent passages 138 may be evenly distributed around the first piston 120 and may be cylindrical in shape. However, other relative positions and profiles of the vent passages have been contemplated.

A first piston ring 146 is coupled the first piston 120. The first piston ring 146 provides a seal between the first piston 120 and the cylinder wall 118. The first piston ring 146 is positioned vertically below the second end 142 of each of the vent passages 138 and vertically above the first end 140 of each of the vent passages 138. Positioning the first piston ring 146 below the second end 142 of each of the vent passages 138 enable gas to flow through the gap 144 into or out of the vent passages 138. Specifically in the depicted example, the first piston ring 146 is positioned directly below the second end 142 of each vent passages 138, to reduce the likelihood of hydrocarbons (e.g., fuel) becoming trapped in a lower section of the gap 144. Additionally, positioning the first piston ring 146 vertically above the first end 140 of each of the vent passages 138 and below the second end 142 enables the exhaust gas to flow upward through the first piston 120. This can potentially enable the hollow body 125 to extend further into the first piston 120, increasing the size of the hollow body 125, if desired.

A second piston ring 148 is coupled to an outer surface 150 of the second piston 124. The second piston ring 148 provides a seal between the second piston 124 and a portion of the interior surfaces 136 of the first piston 120.

The engine system 102 also includes a fuel injector 152 which in the depicted example is a direct fuel injector. Additionally or alternatively the engine 100 may include a port fuel injector configured to inject fuel upstream of the cylinder 108. The fuel injector 152 is configured to deliver a metered amount of fuel to the cylinder 108 at selected time intervals. A fuel delivery system including a fuel tank, pumps, fuel conduits, etc., may be provided in the engine 100 to supply fuel to the fuel injector 152.

The engine 100 may also include an ignition device 154 coupled to the cylinder 108, in the case of a spark ignition engine. However in other instances, the engine may be configured to perform compression-ignition.

A controller 151 may be configured to receive signals from sensors in the engine 100 and engine system 102 as well as send command signals to components such as the ignition device 154, fuel injector 152, intake valve actuator 114, exhaust valve actuator 116, etc., to adjust operation of the components. Various components in the engine system 102 may be controlled at least partially by a control system including the controller 151 and by input from a vehicle operator 153 via an input device 155. The control system may also include actuators and/or other component for adjusting injectors, valves, etc., and sensors described herein. In this example, input device 154 includes an accelerator pedal and a pedal position sensor 156 for generating a proportional pedal position signal PP. The controller 151 is shown in FIG. 1 as a microcomputer, including processor 160 (e.g., microprocessor unit), input/output ports 162, an electronic storage medium for executable programs and calibration values shown as read only memory 164 (e.g., read only memory chip) in this particular example, random access memory 166, keep alive memory 168, and a data bus.

Storage medium read-only memory 164 can be programmed with computer readable data representing instructions executable by processor 160 for performing the methods described below as well as other variants that are anticipated but not specifically listed.

Figure 2:
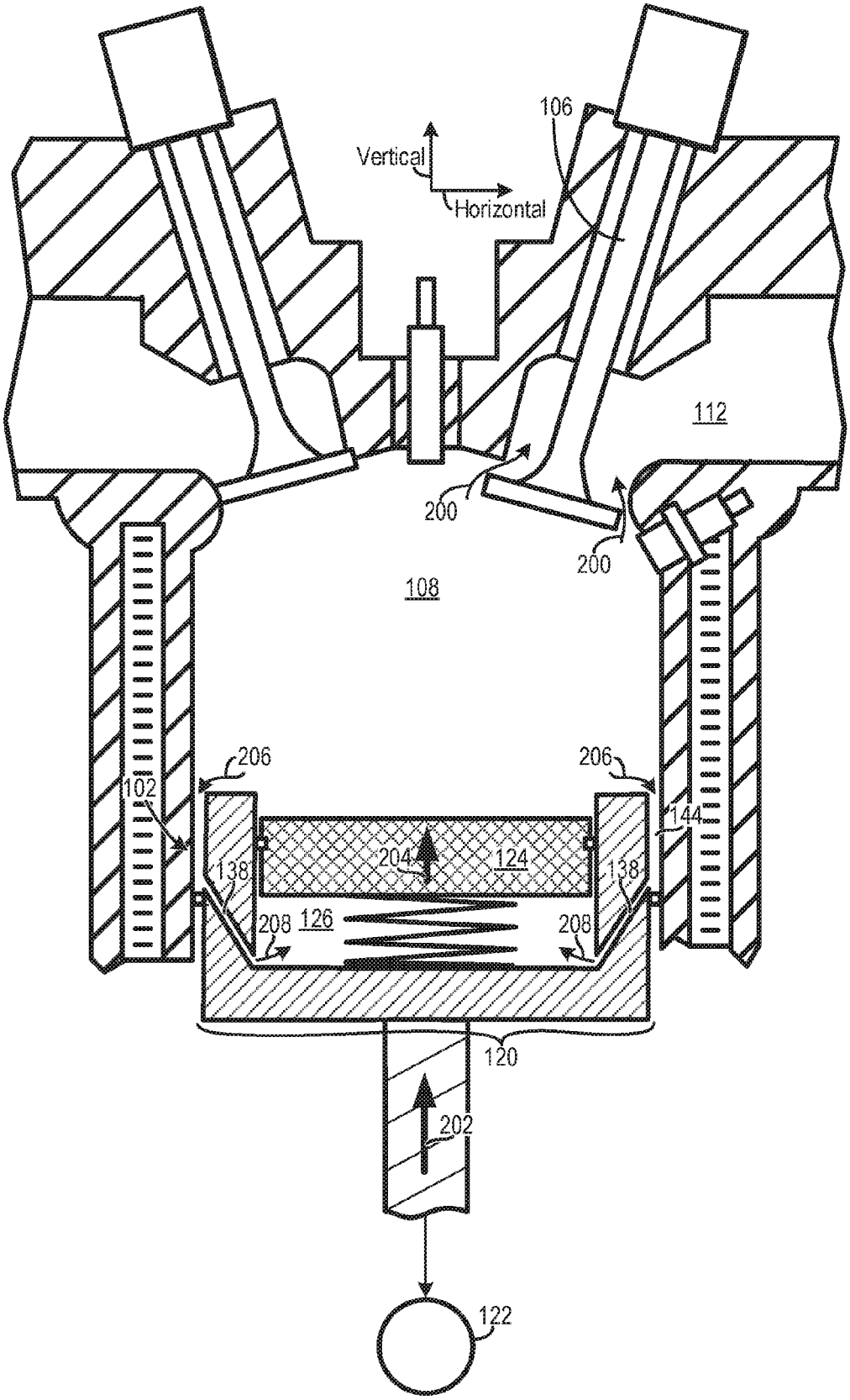
FIGS. 2-5 the engine system of FIG. 1 during different strokes in a combustion cycles where the relative position of the first and second pistons varies.
Figure 3:
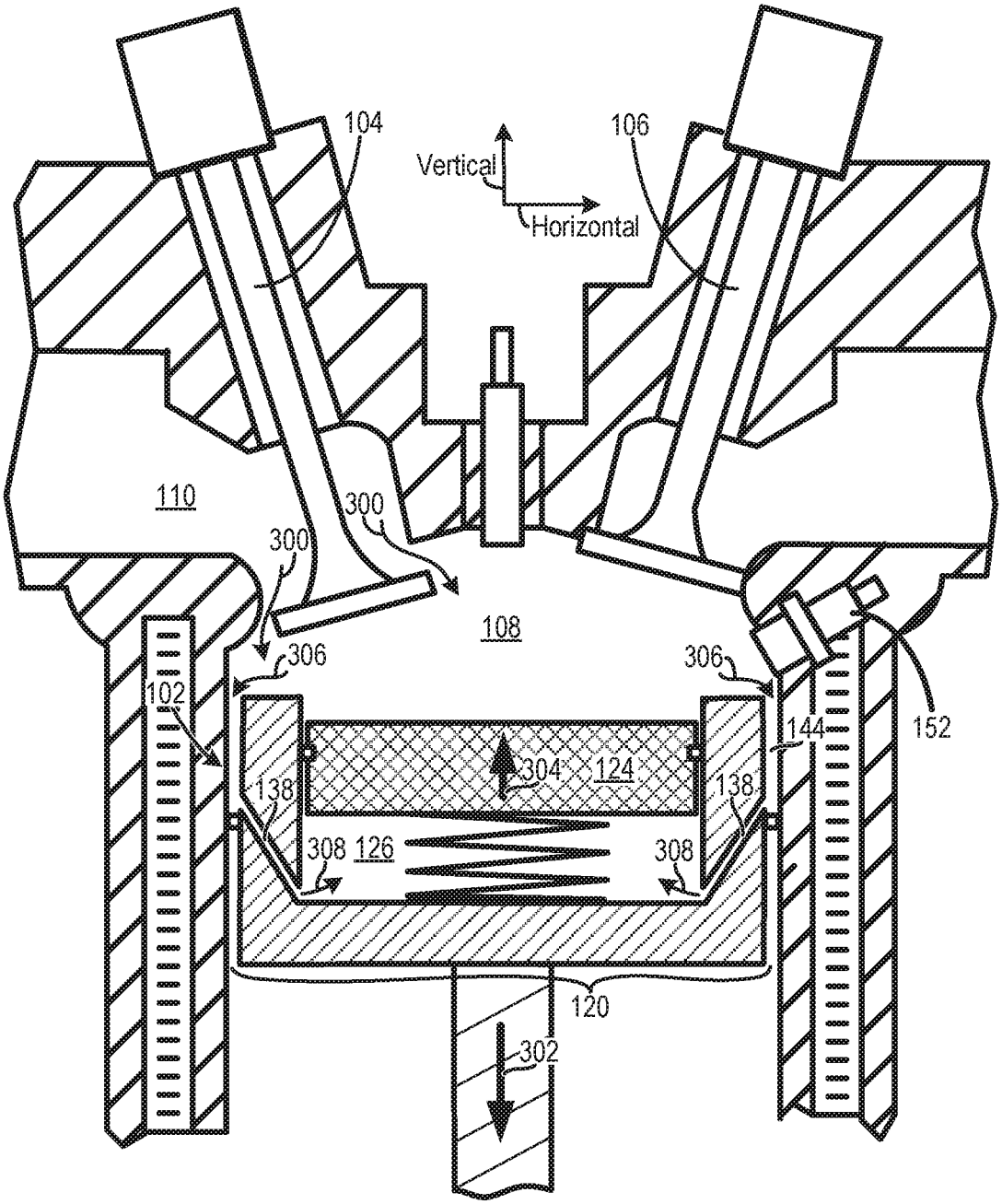
Figure 4:
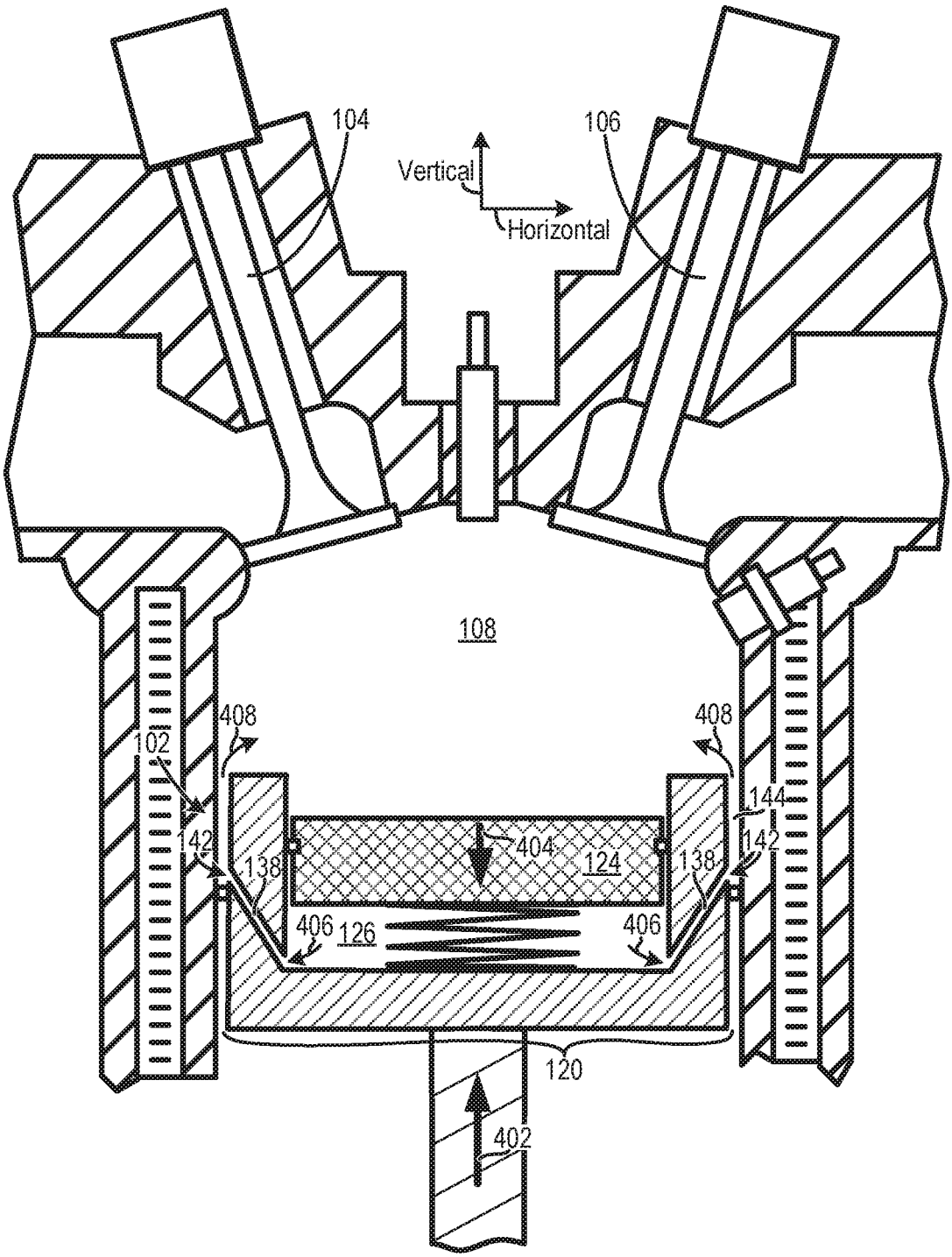
Figure 5:
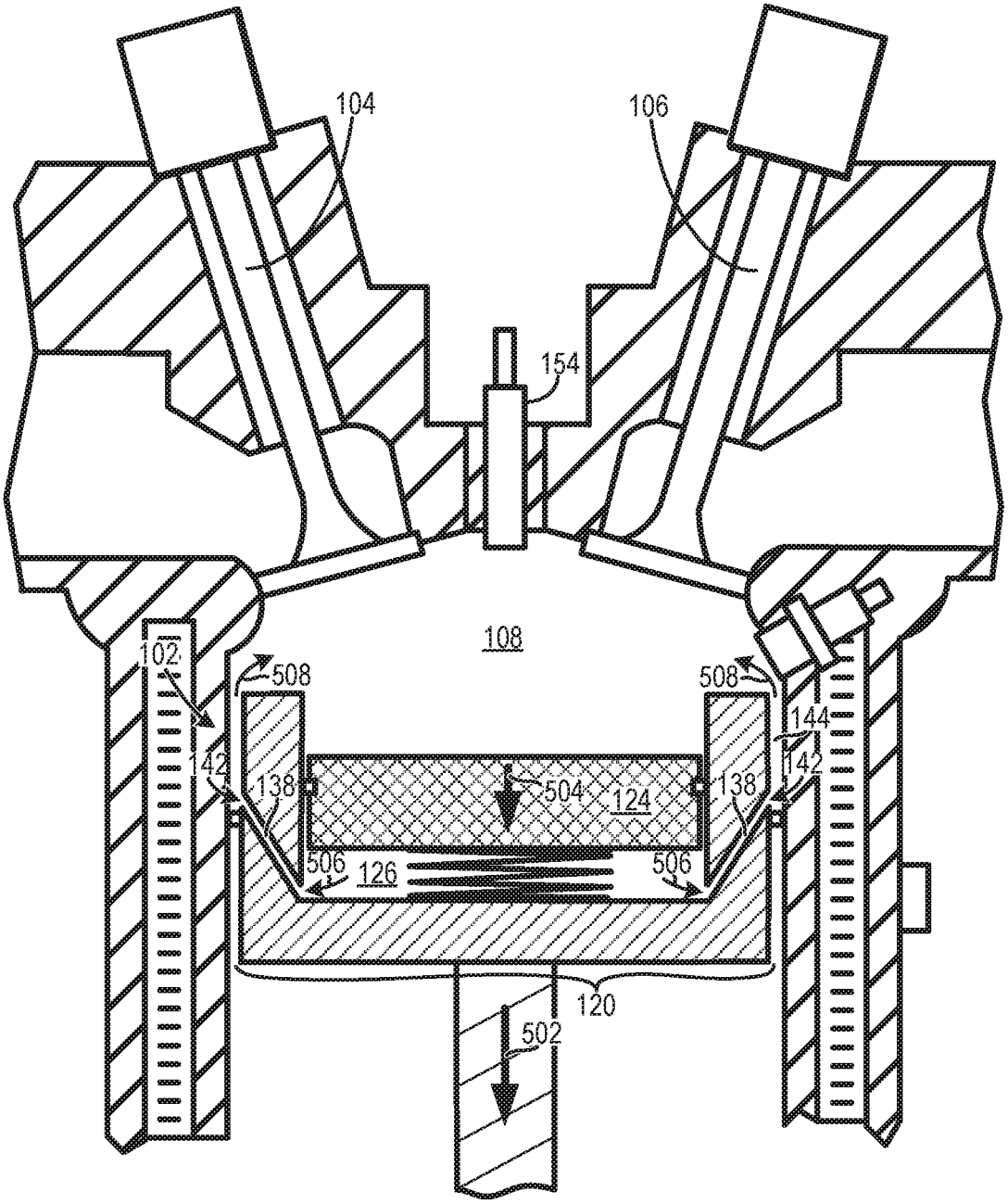

During operation, the cylinder 108 typically undergoes a four stroke combustion cycle: the cycle includes the intake stroke, compression stroke, expansion stroke, and exhaust stroke. The four stroke combustion cycle is described herein with regard to FIGS. 2-5 showing the cylinder 108 and engine system 102 during different phases of a single four stroke combustion cycle. Specifically, FIG. 2 shows the engine system 102 during an exhaust stroke, FIG. 3 shows the engine system 102 during an intake stroke, FIG. 4 shows the engine system 102 during a compression stroke, and FIG. 5 shows the engine system 102 during an expansion stroke. Various arrows depicting gas flow are provided in FIGS. 2-5 to aid in the understanding of the general direction of gas flow during the combustion cycles. However it will be appreciated that the gas flow patterns can have greater complexity than what is illustrated. Additionally, FIGS. 2-5 are shown in the cross-sectional view similar to FIG. 1.

The first piston 120 moves from bottom dead center (BDC) to top dead center (TDC) during the exhaust stroke depicted in FIG. 2. Thus, the first piston 120 moves in an upward direction, indicated by arrow 202, to generate the exhaust gas flow past the exhaust valve 106, during the exhaust stroke. Again, vertical and horizontal axes are provided for reference. The point at which the first piston 120 is at the end of its exhaust stroke (e.g., when cylinder 108 is at its smallest volume) is typically referred to by those of skill in the art as TDC. On the other hand, the position at which the first piston 120 is at the beginning of its exhaust stroke (e.g., when the cylinder 108 is at its largest volume) is typically referred to by those of skill in the art as BDC. Furthermore, during the exhaust stroke illustrated in FIG. 2 the exhaust valve 106 is opened so as to enable exhaust gas to flow from the cylinder 108 into the exhaust conduit 112. The general direction of exhaust gas flow past the exhaust valve 106 is illustrated via arrows 200.

During the exhaust stroke, the second piston 124 is moving in an upward direction, indicated by arrow 204. As such, the volume of the reservoir 126 increases during the exhaust stroke. The increase in volume of the reservoir 126 generates gas flow from the cylinder 108 to the reservoir 126 through the vent passages 138. Arrows 206 indicate the gas flow from the cylinder 108 into the gap 144 and arrows 208 indicate the gas flow from the vent passages 138 into the reservoir 126. Generating gas flow in this pattern enables hydrocarbons (e.g., unburnt fuel) in the gap 144 to be flowed into the reservoir 126 rather than remaining trapped in the gap 144 during subsequent combustion cycle phases. In this way, the reservoir 126 can store hydrocarbons, such as unburnt fuel, to achieve a reduction in emissions. It will be appreciated that exhaust gas from the cylinder 108 also flows through the vent passages 138 into the reservoir during the exhaust stroke. In this way, the reservoir 126 also acts as an internal EGR chamber, enabling a further reduction in emissions to be achieved. Specifically, exhaust gas is flowed into and stored in the reservoir 126 until subsequent compression and expansion strokes, providing EGR functionality.

The first piston 120 moves from TDC to BDC during the intake stroke depicted in FIG. 3. Also during the intake stroke the intake valve 104 is opened and the exhaust valve 106 is closed to enable intake air flow from the intake conduit 110 to the cylinder 108. The general direction of exhaust gas flow past the intake valve 104 is illustrated via arrows 300. During the intake stroke the first piston 120 moves in a downward direction, indicated by arrow 302, to generate intake air flow past the intake valve 104 from the intake conduit 110 into the cylinder 108. Again, vertical and horizontal axes are provided for reference.

During the intake stroke, the second piston 124 is moving in an upward direction, indicated by arrow 304. As such, the volume of the reservoir 126 further increases during the intake stroke. Therefore, it will be appreciated that the volume of the reservoir 126 increases both during the exhaust and intake strokes. The increase in volume of the reservoir 126 generates additional gas flow from the cylinder 108 to the reservoir 126 through the vent passages 138. Specifically, intake air is flowed into the reservoir 126 from the cylinder 108 during the intake stroke. Arrows 306 indicate the gas flow from the cylinder 108 into the gap 144 and arrows 308 indicate the gas flow from the vent passages 138 into the reservoir 126. As mentioned above, generating gas flow in this pattern enables hydrocarbons (e.g., unburnt fuel) trapped in the gap 144 to be flowed into the reservoir 126. Furthermore, intake air may also be flowed into the reservoir 126 during the intake stroke.

The first piston 120 moves from BDC to TDC in an upward direction, indicated by arrow 402, during the compression stroke depicted in FIG. 4. During the compression stroke both the intake valve 104 and the exhaust valve 106 are closed. It will be appreciated that the fuel injector 152 also injects fuel into the cylinder 108 during the compression stroke. However, fuel may also be introduced into the cylinder during the intake stroke depicted in FIG. 3.

Continuing with FIG. 4, during the compression stroke, the second piston 124 is moving in a downward direction, indicated by arrow 404. As such, the volume of the reservoir 126 decreases during the compression stroke. The decrease in reservoir volume generates gas flow from the reservoir 126 to the cylinder 108 through the vent passages 138. Arrows 406 indicate the gas flow from the reservoir 126 into the vent passages 138. Arrows 408 indicate the gas flow from the gap 144 above the second end 142 of each of the vent passages 138. In this way, gas (e.g., fuel vapor, exhaust gas, intake air, etc.,) stored in the reservoir 126 during the exhaust stoke and intake stroke can be released into the cylinder 108 during the compression stoke.

The first piston 120 moves from TDC to BDC in a downward direction, indicated by arrow 502, during the expansion stroke depicted in FIG. 5. During the expansion stroke both the intake valve 104 and the exhaust valve 106 remain closed. It will be appreciated that the ignition device 154 may deliver a spark to the cylinder 108 during the expansion stroke, in the case of a spark ignition engine.

During the expansion stroke, the second piston 124 is moving in a downward direction, indicated by arrow 504. As such, the volume of the reservoir 126 further decreases. Thus, the volume of the reservoir 126 decreases during both the compression stroke and the expansion stroke. The additional decrease in the volume of the reservoir 126 generates additional gas flow from the reservoir 126 to the cylinder 108 through the vent passages 138. Arrows 506 indicate the continued gas flow from the reservoir 126 into the vent passages 138. Additionally, arrows 508 indicate the continued gas flow from the gap 144 above the second end 142 of each of the vent passages 138. This gas flow pattern enables gas (e.g., fuel vapor, exhaust gas, intake air, etc.,) stored in the reservoir 126 during the exhaust stoke and intake stroke to continue to be released into the cylinder 108 during the expansion stroke following the gas release in the compression stroke. In this way, unburnt fuel vapor previously stored in the reservoir 126 can be combusted and oxidized during the expansion stroke to reduce emissions. Additionally, exhaust gas previously stored in the reservoir 126 is flowed back into the cylinder 108 during the compression stroke and compression stroke to provide an internal EGR flow pattern to reduce peak temperature during combustion to further reduce emissions.

Note that the above is shown merely as an example, and that intake and exhaust valve opening and/or closing timings may vary, such as to provide positive or negative valve overlap, late intake valve closing, or various other examples.

Figure 6:
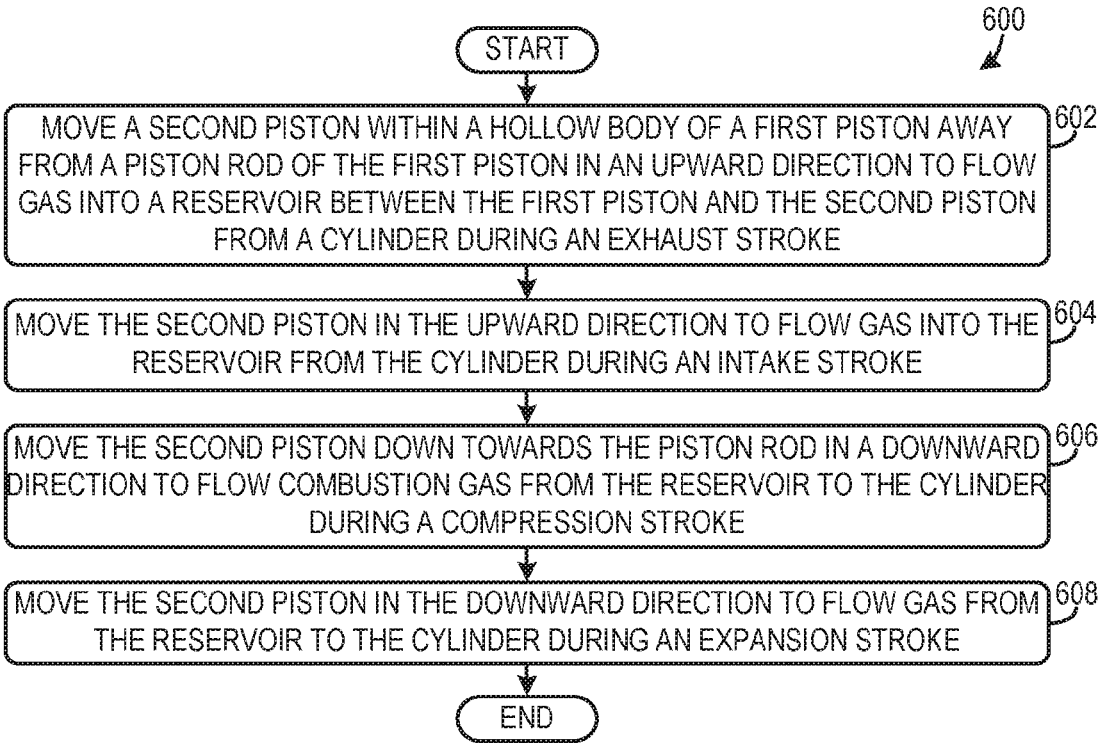
FIG. 6 shows a method for operation of an engine system.

FIG. 6 shows a method 600 for operating of an engine system. The method 600 may be implemented by the engine system described above with regard to FIGS. 1-5 or another suitable engine system.

At 602 the method includes moving a second piston within a hollow body of a first piston away from a piston rod of the first piston in an upward direction to flow gas into a reservoir between the first piston and the second piston from a cylinder during an exhaust stroke. Next at 604 the method includes moving the second piston in the upward direction to flow gas into the reservoir from the cylinder during an intake stroke. In this way, the reservoir may be filled with exhaust gas, intake air, and hydrocarbons (e.g., unburnt fuel vapor) trapped between a cylinder wall and an outer surface of the first piston during both the exhaust and intake strokes.

Next at 606 the method includes moving the second piston down towards the piston rod in a downward direction to flow combustion gas from the reservoir to the cylinder during a compression stroke. At 608 the method includes moving the second piston in the downward direction to flow gas from the reservoir to the cylinder during an expansion stroke. In this way, the exhaust gas, intake air, and hydrocarbons stored in the reservoir during the exhaust and intake strokes can be released into the cylinder and combusted during the expansion stroke. It will be appreciated the exhaust stroke, intake stroke, compression stroke, and expansion stroke are successively implemented during a single combustion cycle.

Further in one example, the gas flows into and out of the reservoir through a vent passage including a first end opening into the reservoir and a second end opening into a gap between a cylinder wall and an outer surface of the first piston. In an additional example, the first end is positioned vertically below a piston ring coupled to an outer surface of the first piston. In such an example, the amount of hydrocarbons trapped between the cylinder wall and the outer surface of the piston can be reduced.

The figures show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The subject matter of the present disclosure is further described in the following paragraphs. According to one aspect, an engine system is provided. The engine system includes a first piston movable within a cylinder, a second piston movable within a hollow body of the first piston, the movement defining a boundary of a reservoir within the hollow body, a spring device coupled to the first piston and the second piston, and a vent passage fluidically connecting the reservoir to the cylinder.

In another aspect, a method for operating an engine system is provided. The method includes moving a second piston within a hollow body of a first piston away from a piston rod of the first piston in an upward direction to flow gas into a reservoir between the first piston and the second piston from a cylinder during an exhaust stroke and moving the second piston down towards the piston rod in a downward direction to flow combustion gas from the reservoir to the cylinder during a compression stroke.

In another aspect, an engine system is provided. The engine system includes a first piston movable within a cylinder, a second piston movable within a hollow body of the first piston, the movement defining a boundary of a reservoir within the hollow body, a spring device coupled to the first piston and the second piston, and a vent passage fluidically connecting the reservoir to the cylinder and including a first end opening into the reservoir and a second end opening into a gap between a cylinder wall and an outer surface of the first piston.

In any of the aspects described herein or combinations of the aspects, the vent passage can include a first end opening into the reservoir and a second end opening into a gap between a cylinder wall and an outer surface of the first piston.

In any of the aspects described herein or combinations of the aspects, the engine system may further include a piston ring coupled to the outer surface of the first piston vertically below the second end of the vent passage.

In any of the aspects described herein or combinations of the aspects, the first end may be positioned vertically below the piston ring.

In any of the aspects described herein or combinations of the aspects, a volume of the reservoir may increase during an exhaust stroke and an intake stroke of the first piston, the increase in reservoir volume generating gas flow from the cylinder to the reservoir through the vent passage.

In any of the aspects described herein or combinations of the aspects, a volume of the reservoir can decrease during a compression stroke and a expansion stroke of the first piston, the decrease in reservoir volume generating gas flow from the reservoir to the cylinder through the vent passage.

In any of the aspects described herein or combinations of the aspects, the vent passage may extend in an upward direction away from a piston rod of the first piston.

In any of the aspects described herein or combinations of the aspects, the spring device may be positioned within the reservoir.

In any of the aspects described herein or combinations of the aspects, the engine system may further include a direct fuel injector extending into the cylinder.

In any of the aspects described herein or combinations of the aspects, the method may further include moving the second piston in the upward direction to flow gas into the reservoir from the cylinder during an intake stroke.

In any of the aspects described herein or combinations of the aspects, the method may further include moving the second piston in the downward direction to flow gas from the reservoir to the cylinder during an expansion stroke.

In any of the aspects described herein or combinations of the aspects, the gas flowing into and out of the reservoir can include unburnt fuel vapor.

In any of the aspects described herein or combinations of the aspects, the gas can flow into and out of the reservoir through a vent passage including a first end opening into the reservoir and a second end opening into a gap between a cylinder wall and an outer surface of the first piston.

In any of the aspects described herein or combinations of the aspects, the first end may be positioned vertically below a piston ring coupled to an outer surface of the first piston.

In any of the aspects described herein or combinations of the aspects, a volume of the reservoir can increase during an exhaust stroke and an intake stroke of the first piston, the increase in reservoir volume generating gas flow from the cylinder to the reservoir through the vent passage.

In any of the aspects described herein or combinations of the aspects, a volume of the reservoir can decrease during a compression stroke and an expansion stroke of the first piston, the decrease in reservoir volume generating gas flow from the reservoir to the cylinder through the vent passage.

In any of the aspects described herein or combinations of the aspects, the vent passage may extend in an upward direction away from a piston rod of the first piston.

In any of the aspects described herein or combinations of the aspects, the engine system may further include a piston ring coupled to the outer surface of the first piston vertically below the second end of the vent passage.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. An engine system comprising:

a first piston movable within a cylinder;

a second piston movable within a hollow body of the first piston, the movement of the second piston defining a boundary of a reservoir within the hollow body;

a spring device coupled to the first piston and the second piston; and a vent passage extending through a section of the first piston and fluidically connecting the reservoir to the cylinder to provide combustion gas flow between the reservoir and the cylinder.

2. The engine system of claim 1, where the vent passage includes a first end opening into the reservoir and a second end opening into a gap between a cylinder wall and an outer surface of the first piston.

3. The engine system of claim 2, further comprising a piston ring coupled to the outer surface of the first piston vertically below the second end of the vent passage.

4. The engine system of claim 3, where the first end is positioned vertically below the piston ring.

5. The engine system of claim 1, where a volume of the reservoir increases during an exhaust stroke and an intake stroke of the first piston, the increase in reservoir volume generating gas flow from the cylinder to the reservoir through the vent passage.

6. The engine system of claim 1, where a volume of the reservoir decreases during a compression stroke and an expansion stroke of the first piston, the decrease in reservoir volume generating gas flow from the reservoir to the cylinder through the vent passage.

7. The engine system of claim 1, where the vent passage extends in an upward direction away from a piston rod of the first piston.

8. The engine system of claim 1, where the spring device is positioned within the reservoir.

9. The engine system of claim 1, further comprising a direct fuel injector extending into the cylinder.

10. A method for operating an engine system, comprising:

moving a second piston within a hollow body of a first piston away from a piston rod of the first piston in an upward direction to flow gas into a reservoir between the first piston and the second piston from a cylinder during an exhaust stroke; and moving the second piston down towards the piston rod in a downward direction to flow combustion gas from the reservoir to the cylinder during a compression stroke;

where the gas flows into and out of the reservoir through a vent passage including a first end opening into the reservoir and a second end opening into a gap between a cylinder wall and an outer surface of the first piston.

11. The method of claim 10, further comprising moving the second piston in the upward direction to flow gas into the reservoir from the cylinder during an intake stroke.

12. The method of claim 10, further comprising moving the second piston in the downward direction to flow gas from the reservoir to the cylinder during an expansion stroke.

13. The method of claim 10, where the gas flowing into and out of the reservoir includes unburnt fuel vapor.

14. The method of claim 10, where the first end of the vent passage is positioned vertically below a piston ring coupled to the outer surface of the first piston.

15. An engine system comprising:

a first piston movable within a cylinder;

a second piston movable within a hollow body of the first piston, the movement of the second piston defining a boundary of a reservoir within the hollow body;

a spring device coupled to the first piston and the second piston; and a vent passage extending through a section of the first piston and fluidically connecting the reservoir to the cylinder to provide combustion gas flow therebetween, the vent passage including a first end opening into the reservoir and a second end opening into a gap between a cylinder wall and an outer surface of the first piston.

16. The engine system of claim 15, where a volume of the reservoir increases during an exhaust stroke and an intake stroke of the first piston, the increase in reservoir volume generating gas flow from the cylinder to the reservoir through the vent passage.

17. The engine system of claim 15, where a volume of the reservoir decreases during a compression stroke and an expansion stroke of the first piston, the decrease in reservoir volume generating gas flow from the reservoir to the cylinder through the vent passage.

18. The engine system of claim 15, where the vent passage extends in an upward direction away from a piston rod of the first piston.

19. The engine system of claim 15, further comprising a piston ring coupled to the outer surface of the first piston vertically below the second end of the vent passage.

* * * * *